United States Patent [19]

Rosenberg et al.

[11] 4,221,628

[45] Sep. 9, 1980

[54] APPLICATOR FOR LAYING ROLLED SHEET MATERIAL

[75] Inventors: Arnold M. Rosenberg, Potomac; James M. Gaidis, Ellicott City, both of Md.

[73] Assignee: W. R. Grace & Co., New York, N.Y.

[21] Appl. No.: 21,106

[22] Filed: Mar. 16, 1979

[51] Int. Cl.[2] ..... B44C 7/02; E04D 15/06

[52] U.S. Cl. ..... 156/577; 156/579; 242/129.6

[58] Field of Search ..... 156/574, 577, 579, 584, 156/523, 527, 538, 71; 242/86.52, 130, 134, 128, 129.6; 222/191

[56] References Cited

U.S. PATENT DOCUMENTS

| | | | |
|---|---|---|---|
| 431,773 | 7/1890 | Knight | 242/129.6 |
| 763,768 | 6/1904 | Kerns et al. | 156/574 |
| 3,393,114 | 7/1968 | Jorgensen | 156/577 |
| 3,559,914 | 2/1971 | Alderman | 242/86.52 |
| 3,733,689 | 5/1973 | Armitage | 156/574 X |

*Primary Examiner*—Michael G. Wityshyn

*Attorney, Agent, or Firm*—Howard J. Troffkin; William W. McDowell, Jr.

[57] ABSTRACT

An applicator suitable for one-man application of sheet material in an accurate manner onto structural substrates wherein the applicator can direct changes in the path of application while readily maintaining control over the roll of sheet material.

7 Claims, 3 Drawing Figures

APPLICATOR FOR LAYING ROLLED SHEET MATERIAL

BACKGROUND OF INVENTION

The present invention relates to an apparatus useful for application of sheet material, especially self-adhesive, waterproofing sheet material. More particularly, the present invention relates to an apparatus whereby a roll of waterproofing sheet material can be readily placed on a substructure surface in an accurate manner and by a one-man operation.

Various types of sheet material are used in forming a waterproof roof or other substructure system. Included among such materials are bituminous impregnated sheet material commonly known as tar paper or felt. More recently, preformed, flexible, sheet-like membranes of waterproofing, pressure-sensitive adhesives such as are disclosed in U.S. Pat. Nos. 3,741,856; 3,853,683 and 3,900,102 have been formed. Each of these materials must be applied to the roof substructure in an accurate manner to insure complete abutment or, preferably, overlap of the successively applied layers. Normally such an operation is laborious, requiring an extensive amount of stooping, bending and the like, and at least two persons to attain accurate application.

Various types of apparatus have been devised for the application of roofing material or other stock material from storage rolls. U.S. Pat. Nos. 2,439,681 and 3,559,914 disclose such apparatus. These prior art apparatus have not found general acceptance because they are of complex design, are not capable of being operated by one person and do not permit change of direction during application of a single course of roofing material.

The presently described applicator permits easy application of rolls of tar paper, bituminous impregnated felt products and most especially, preformed waterproofing, pressure-sensitive adhesive sheet material used to cause waterproofing of various substructures such as roofs. The utilization of the subject applicator shall be described in relation to the application of a waterproofing, pressure-sensitive adhesive sheet material. The application of other rolled stock material onto substructures can also be readily performed in manners which will be obvious from the present teaching.

SUMMARY OF THE INVENTION

The subject invention is directed to a simple, yet effective one-man operable apparatus for application of sheet material and the like in roll form. The apparatus comprises a U-shaped body of continuous length having a handle portion and a pair of leg portions extending from the opposite ends of the handle portion. The free end of each leg portion has a mounting means connected thereto. The mounting means of each leg portion is perpendicularly connected to the respective leg portion and is in facing relationship with the other mounting means. The subject applicator further comprises a rigid, stabilizing member positioned between the leg portions and having, at the opposite free ends of said stabilizing member a slidable constraining means whereby the stabilizing member is slidable axially along the leg members in substantially parallel attitude with respect to said handle portion. The constraining means further permits the leg portions to be sprung outwardly and apart when the stabilizer member is close to the handle portion of the body and to be forced inwardly when in a predetermined closely spaced relationship to the free ends of the leg portions.

DETAILED DESCRIPTION OF THE PREFERRED EMBODIMENT

Rolls of preformed, waterproofing, pressure-sensitive adhesive sheet material are generally applied by unrolling the material onto a roof or other substructure so that the adhesive membrane is adjacent to the substructure and its polymeric support membrane is on the resultant exposed side. Although the adhesive properties of the membrane enhance its waterproofing ability, they normally detract from its being readily applied in an accurate manner over long courses. Further, the adhesiveness and bulk of such material causes extensive twisting or torque forces to be exerted on the applicator when attempting even slight changes of direction of application. Such torque forces normally cause loss of control of the roll of material.

The present applicator permits a simple mode of application of such normally difficult-to-apply waterproofing material with accurate and correct alignment on a substructure. Further, the present applicator readily permits one-man application of such normally difficult-to-apply material. Finally, the present applicator securely holds the roll of roofing material under varying torque or twisting forces produced during the guidance and change of direction of application such as are especially incurred when applying adhesive membrane roofing material.

Figure 1:
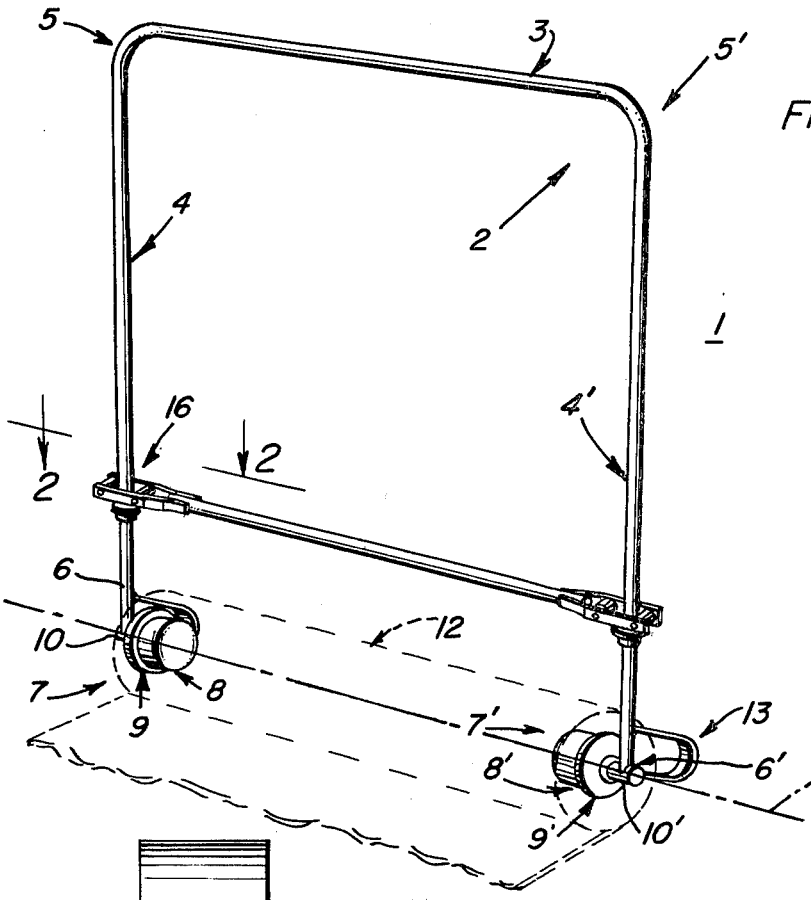
FIG. 1 is a perspective view of an applicator apparatus according to a preferred embodiment of the present invention.

Referring to FIG. 1, there is illustrated an applicator apparatus 1 for applying rolls of sheet roofing material 12. The applicator body 2 is expediently made from metal rod or tubular material bent into a modified U-shape configuration to form a handle portion 3 and leg portions 4 and 4'. One end of each of the leg sections 4 and 4' is integrally connected at 5 and 5' with the opposite ends of handle portion 3. Each of the leg portions is slightly sprung in an outward manner, that is, the distance between the free ends 6 and 6' of leg portions 4 and 4' is greater than the distance between connections 5 and 5'. The applicator body can alternatively be formed from sections of metal rod or tubular material by securely connecting, such as by welding or equivalent means, the sections so as to form the desired integral configuration. The opposite free ends 6 and 6' of leg portions 4 and 4', respectively, have perpendicularly connected thereto mounting means 7 and 7'. Each of the mounting means is in face-to-face relationship with the other and comprises a chuck in the form of a cylindrical member 8 which extends axially along an imaginary line 11 connecting the free ends 6 and 6' of each leg portion 4 and 4'. The radius of the cylindrical member 8 should be substantially that of the inside radius of a standard cylindrical core (not shown) upon which the conventional sheet material is wound and shipped.

To aid in mounting the roll of roofing material on the chuck, it is preferable that the radius of cylindrical member 8 become smaller in direct relationship to the distance from the leg section to which the mounting means is connected. The mounting means may further comprise a collar member 9 having a radius extending outwardly from axis 11 which is greater than the radius of the cylindrical core of the roofing material and thereby aids in holding the roll of roofing material in its mounted position. Members 8 and 9 can be formed from any durable material such as wood, metal or plastic. Each mounting means further comprises a connector rod 10 to connect the cylindrical chuck 8 and collar 9 to the free end of a leg section. The connector rods 10 are connected to cylindrical chucks 8 or cylindrical collar member 9 in a manner to permit rotation of members 8 and 9 about axis 11 to facilitate the rotation of the roll of roofing material when being applied to the substructure as described hereinbelow.

The apparatus of the present invention further comprises a stabilizing means 15 which is located between leg portions 4 and 4' and is in the form of a rigid bar. The opposite ends of stabilizing bar 15 are each connected to leg sections 4 and 4' by slidable constraining means 16 and 16', respectively. The constraining means 16 and 16' are rigid members circumventing around each of the respective leg portions 4 and 4', and in slidable relationship therewith.

The stabilizing bar 15 is capable of axial movement via the constraining means along the leg portions in a manner which requires the stabilizing bar to be in substantially parallel attitude with respect to the handle portion 3. The movement of the stabilizing bar 15 is further limited to between special positions of close or adjacent to the handle portion 3 and of a predetermined lower position (close to the leg portion free ends) which is defined by a collar or other stoppage means.

Each leg section 4 and 4' has connected thereto a stop means 14 such as in the form of a collar extending radially outwardly from the leg section. Each stop means 14 is connected to the leg section at a point from the leg section's free end 6 of at least greater than the radius of a standard full roll of roofing material to about a distance of one-third of the leg section. The stop means arrests the downward movement and supports, at its lowest position, the stabilizing bar and its associated constraining mounting means as described hereinbelow.

Mounted on each leg section 4 and 4' in the neighborhood of the free ends 6 and 6', respectively, is a support means 13 which is shown in the form of a rocker stand member. Each support means 13 is mounted on a leg section substantially perpendicular to the axis line 11, at a right or oblique angle with the leg section 4 and extending in an outward radial direction a distance greater than the radius of a standard full roll of roofing material.

Figure 2:
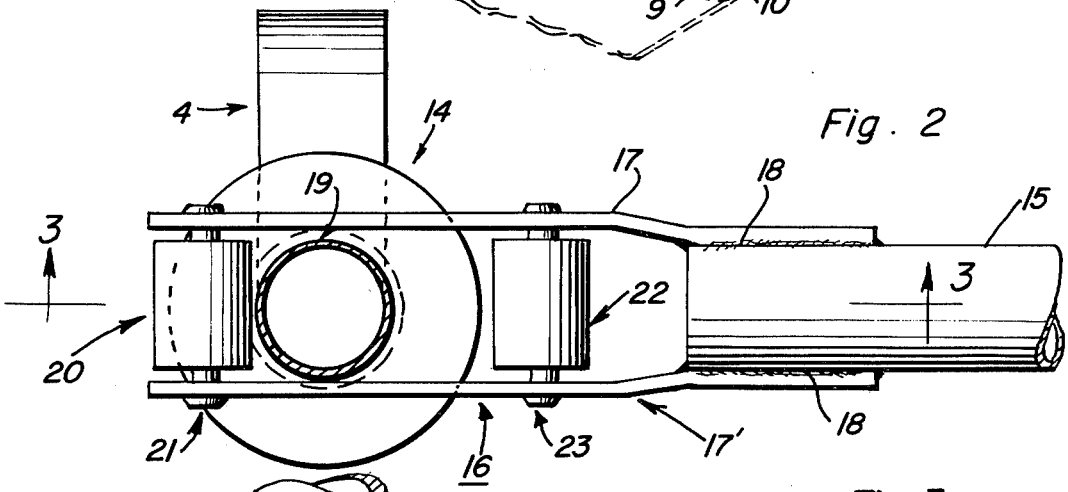
FIG. 2 is a sectional view of the stabilizing bar and slidable mounting of the applicator apparatus of FIG. 1 as taken along lines 2—2 therein.

FIG. 2 shows a detailed view of a preferred slidable constraining means 16 and its relationship with the stabilizing bar 15, stop means 14 and leg portion 4. The same relationship exists with respect to leg portion 4'. Rigid stabilizing bar 15 has its end connected at 18 to rigid plate members 17 and 17'. Plate members 17 and 17' are parallel to and spaced from one another at a distance slightly greater than the diameter or width of leg section 4. The clearance 19 should be sufficient to allow free slidable movement of the plate members 17 and 17' along leg section 4. The distance between the plates should not be greater than about 1.5 times the radius of the leg section 4. Plate members 17 and 17' are to be a length sufficient to extend beyond and to have a member connecting the plates exterior to the outer portion of the leg portion 4. The connecting member is shown as a guide roller 20 mounted on axle pin 21 between plates 17 and 17' at a point outside of body 2. The opposite ends of pin 21 are connected to plates 17 and 17' substantially perpendicular thereto. Further, a guide roller 22 and its axle pin 23 are located between plates 17 and 17' at a point between leg portion 4 and stabilizing bar 15. The axle pin 23 is connected to plates 17 and 17' and substantially perpendicular thereto.

Figure 3:
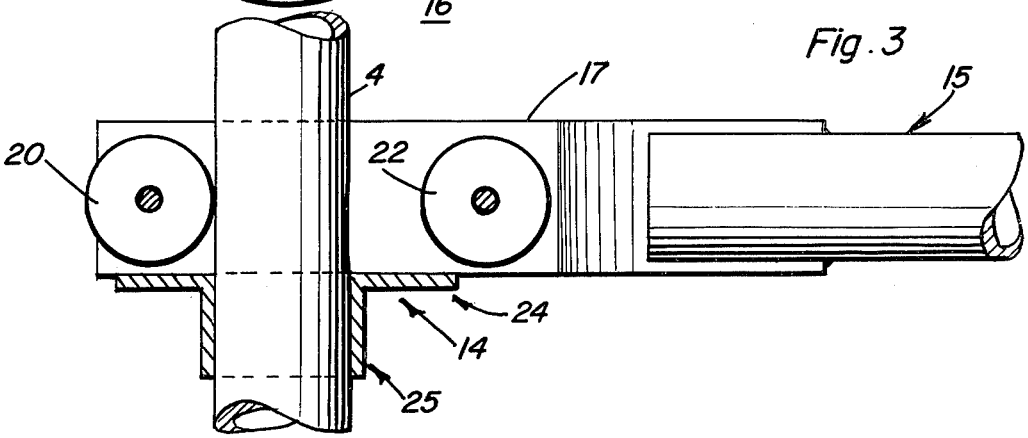
FIG. 3 is a sectional view of the stabilizing bar, slidable mounting and leg portion of the body member shown in FIG. 2 as taken along line 3—3 therein.

FIG. 3 is a cross-sectional view of constraining means 16, and illustrates the interrelationship of the stabilizing bar 15, the parts of the illustrated preferred constraining means 16, leg portion 4 and stop means 14. The leg portion 4 of the applicator body 2 has mounted thereon a stop means 14 which is shown in the form of a collar 24 and support sleeve 25. The collar 24 extends radially outwardly from leg 4 at a distance such that plates 17 and 17' of constraining means 16 rest thereon and are stopped thereby from going to a lower position with respect to leg 4. As stated hereinabove, leg 4 is part of applicator body 2 which is in a modified U-shape, that is, the leg members are sprung slightly outwardly from center. When the stabilizer bar is in the lower position, i.e., adjacent to stop means 14, the outer guide roller 20 and its counterpart on the opposite guide 16' are at a distance from each other so as to guide the leg sections of body 2 inwardly a distance to permit mounting means 7 and 7' to be inserted into the core (not shown) of the roll of sheeting material 12. In this position the interaction of the rigid bar 15 and the constraining means 16 causes a stabilization of the applicator against varying torque forces and the like, secures the mounting of the roll of sheet material and permits the one-man application of the sheet material on a substructure surface in an accurate manner. When stabilizing bar 15 is moved into an upper position, i.e., adjacent to handle 3, guide rollers 20 and 22 aid in guiding the movement without causing binding between leg 4 and mounting means 16.

The subject applicator has been found to permit easy, accurate, one-man application of roofing material. The applicator has been found to be especially useful in the application of adhesive, waterproofing bituminous sheet compositions, and such application will be discussed herein to illustrate the usefulness of the present applicator.

Waterproofing pressure-sensitive sheet compositions must be accurately laid to cause complete butting of the edges or a certain degree of overlap (depending on the type of material used) to form a watertight joint between adjacent courses of the laid sheet material. The body 2 of the present applicator is placed in a substantially horizontal position permitting supports 13 to raise the mounting members 7 above horizontal to aid in mounting the roll of roofing material 12 onto members 7. The stabilizing bar 15 is positioned adjacent to handle 3 to permit leg portions 4 and 4' to be sprung sufficiently outwardly to readily permit the mounting of the roll 12 onto mounting means 7 and 7'. Stabilizing bar 15 is then moved to its lower position, i.e., against stop 14, thus causing guide rollers 20 to force legs 4 and 4' to move inwardly and to cause the chucks of mounting means 7 and 7' to be substantially inserted and maintained in the core of sheet material 12.

The roll of waterproofing material, comprising a sheet of adhesive bituminous composition laminated with a support sheet, should be positioned on the applicator so that the adhesive bituminous composition is directly applied to the substructure when the applicator/roofing roll is rolled in a direction towards the support members 13. The body 2 of applicator 1 is raised to a position suitable for handling by the user and tilted away from the side of the support members 13. The stabilizing bar 15 and its accompanying slidable mounting means are held in the lower position by the force of gravity and by constraining means 16.

The roll of material 12 can be readily applied to a substructure by a single individual pushing the roll 12 along the desired course to deposit the sheet material 12' on the substructure. The adhesive properties of this waterproofing sheet material readily adhere to the substructure via the pressure exerted on it by the unconsumed roll. Changes and corrections of direction of application can be readily accomplished without loss of control of the roll of unused materials due to the unexpected rigidity and strength given to the applicator structure through the stabilizer bar and the constraining means associated therewith.

From the foregoing description it can be appreciated that the applicator of the present invention is adaptable to numerous variations and modifications to suit the needs of specific applications and while being described in connection with waterproofing sheet-like bituminous roofing material it can be used for application of other similar materials and for application of such materials to other substructures.

What is claimed is:

1. An applicator for laying sheet material rolled on a core onto a surface, said applicator being of generally U-shaped configuration comprising a central handle portion and first and second leg portions depending from opposite ends of the handle portion with respect to each other, and each having a free end, means at said free ends for mounting said rolled material and core therebetween, a rigid stabilizer member positioned between said first and second leg portions, means at opposite ends of said stabilizer member to constrain motion of said stabilizer member axially along said leg portions in substantially parallel attitude with respect to said handle portion in all positions, and permitting said leg portions to be sprung apart when said stabilizer member is in closely spaced relationship to said handle portion and inwardly forcing each of said leg portions' free ends when said stabilizer member is in a predetermined closely spaced relationship to said leg portions' free ends.

2. The apparatus according to claim 1, wherein each of the constraining means attached to the opposite free ends of the stabilizing bar comprises first and second rigid constraining plates extending parallel and in spaced relationship to each other on opposite sides of the respective closely spaced leg portions of said body member, first and second axle ping, each pin connecting the first and second mounting plates in substantially perpendicular arrangement therewith, said first axle pin being spatially located between the end of the stabilizing bar and the respective closely spaced leg portion, said second axle pin being spatially located exterior to said leg portion, and first and second roller means mounted, respectively, on said first and second axle pins.

3. The apparatus according to claim 1, wherein a stop means for arresting the downward movement of said stabilizer member is mounted on each of said leg portions at a predetermined distance from each of said leg portions' free ends.

4. The apparatus according to claims 1, 2 or 3, wherein the handle and leg portions of said applicator are formed from a continuous tubular member.

5. The apparatus according to claim 2 wherein said first and second constraining plates are spaced from each other a distance of from greater than to about 1.5 times the cross-sectional dimension of the leg portion.

6. The apparatus according to claim 1, wherein said constaining means is capable of inwardly forcing said free ends of said leg portions to cause the mounting means to engage with the core of sheet material.

7. The apparatus according to claim 1, which further comprises support means located at substantially the free end of each leg portion for raising said free ends a pre-determined distance above the surface, said support means being so located as to not interfere with the laying of sheet material onto a surface and so located and dimensioned so as to raise said free ends a pre-determined distance above the surface when the handle portion is positioned adjacent to the surface.

* * * * *